US005873184A

United States Patent [19]

Ihlenburg

[11] Patent Number: 5,873,184

[45] Date of Patent: Feb. 23, 1999

[54] CLEATED ATHLETIC SHOE SOLE FOR TRACTION AND STABILITY

[75] Inventor: Frederick H. Ihlenburg, Lake Oswego, Oreg.

[73] Assignee: Adidas America, Inc., Portland, Oreg.

[21] Appl. No.: 571,282

[22] Filed: Dec. 12, 1995

Related U.S. Application Data

[63] Continuation of Ser. No. 282,902, Jul. 29, 1994, abandoned.

[51] Int. Cl.[6] ..... A43C 15/00; A43B 23/28; A43B 5/00

[52] U.S. Cl. ..... 36/67 R; 36/59 C; 36/126

[58] Field of Search ..... 36/59 R, 134, 36/126, 127, 128, 129, 114, 67 R, 59 C

[56] References Cited

U.S. PATENT DOCUMENTS

| | | | |
|---|---|---|---|
| 2,001,976 | 5/1935 | Riddell | 36/126 X |
| 3,040,450 | 6/1962 | Phillips | 36/126 |
| 4,527,344 | 7/1985 | Mozena | 36/126 |
| 4,590,693 | 5/1986 | Kawashima et al. | 36/126 |
| 4,667,425 | 5/1987 | Effler et al. | 36/126 |
| 4,914,838 | 4/1990 | Thuenburg | 36/128 X |

*Primary Examiner*—B. Dayoan
*Attorney, Agent, or Firm*—Chernoff, Vilhauer, McClung & Stenzel

[57] ABSTRACT

A sole for a sport shoe to provide increased traction and stability comprises a main sole member having a heel portion including a heel curve and a forward position underlining the ball of the foot including a toe curve. The main sole member has a center point defined by the intersection of an optical center line and a transverse line. The optical center line and the transverse line defines four quadrants, namely, a forward lateral, a forward medial, a rearward lateral, and a rearward medial. A forward medial cleat is located generally on a first radial line 30 degrees to the medial side of the optical center line about the center point and spaced generally 44% of the length of the transverse line from the center point. A rearward lateral cleat is located on a second radial line generally 130 degrees to the lateral side of the optical center line about the center point and spaced generally 59% of the length of the transverse line from the center point. A rearward medial cleat and a forward lateral cleat are respectively located in the rearward medial quadrant and the forward lateral quadrant.

12 Claims, 1 Drawing Sheet

10
12
14
16
18
20
22
24
26
28
30
32
34
40
41
42
43
44
46
50
52
60
62
70
72
80
82
90
92
3
α

CLEATED ATHLETIC SHOE SOLE FOR TRACTION AND STABILITY

This is a continuation of application Ser. No. 08/282,902 filed Jul. 29, 1994, now abandoned.

BACKGROUND OF THE INVENTION

The present invention relates to athletic shoes and more particularly to cleated athletic shoes.

Cleated or spiked athletic shoes have been designed using a variety of different cleat arrangements to facilitate anchoring the shoe to a playing surface when running or changing directions. The traditional design of such shoes includes a plurality of cleats located on the sole of the shoe, with a main traction cleat located under the large metatarsal joint of the big toe. Downwardly directed force generated during activity by the wearer tends to cause the main traction cleat to impact the ground directly under the metatarsal joint, which acts like a hammer driving the main traction cleat into the ground. An outside cleat is typically placed laterally and slightly rearwardly of the main traction cleat, substantially along the metatarsal joint chain of bones in the foot, which also results in the outside cleat being driven into the ground by the metatarsal joint bones. A major disadvantage with such a design is that using the metatarsal joint to drive cleats into the ground may cause discomfort and bone bruising injuries.

There have been many attempts to improve upon the traditional design of cleated athletic shoes to over-come this problem. George, U.S. Pat. No. 4,347,674 discloses a cleat arrangement with at least three thin arcuate cleats arranged in a ring at the ball portion of the sole. Tanel, U.S. Pat. No. 4,577,422 discloses a circular cleat formed on a forward portion of the sole substantially encompassing the ball of the foot and toe portions of the sole, and is centered at the juncture thereof. Ihlenburg, U.S. Pat. No. 4,914,838 discloses a cleated athletic shoe that relies upon a substantially circular pattern of cleats to specifically address the issue of comfort for the wearer.

With the traditional cleat arrangement where the outside cleat is placed laterally, substantially along the metatarsal joint chain of bones in the foot; and also in the George patent where the rearmost outside cleat is located just rearward of the metatarsal joint chain and the Tanel or Ihlenburg patents with their circular cleat arrangement, the outside cleat, or portion of Tanel's cleat, causes significant destabilization of the player's upright stance when lateral forces are applied to the foot by a significant lateral shift of the wearer's body weight over the outside cleat. In these prior art shoes the outermost or rearward outermost cleat is either directly or significantly in line with this lateral motion, thereby not permitting sufficient room for absorption of the stopping action of the cleat by the leg. This abrupt termination of the motion of the shoe by the outermost cleat being directly in line with or more or less in line with the lateral motion, is much like tripping over an unexpected object.

While circular cleat patterns provide improved comfort over the traditional cleat pattern, by placing the cleats in a substantially circular pattern, where the cleats are placed an equal distance on substantially the same radius from a specific point generally located at the juncture of the center of the phalanges where it intersects the metatarsals or at the ball portion of the shoe, stability and traction is no better than with the traditional cleat pattern. This is because this cleat arrangement is based upon the theory that an athlete who is involved in an activity requiring significant pivot changes of direction does so on the forwardmost portions of his or her feet (e.g., with weight placed on the area forward of the metatarsals toward the end of the toes or phalanges) with the toes flexed and the foot extending forward at a significant angle from the flexed point. This is not the case. In fact, such changes normally occur with the weight placed further back on the sole. Thus, a circular cleat arrangement also in effect causes a person to trip over either the forward medial or rearward lateral cleat when suddenly changing direction while running.

In addition, the foot of the majority of individuals impacts the playing surface in a pronated position, e.g., with the foot turned slightly under thereby impacting the lateral side of the foot before the flat bottom plane of the foot. With cleats on the lateral side of the sole orientated at a right angle to the sole, the cleats impact the ground at an exaggerated angle of attack causing significant torque to be applied to the cleats and the athlete's leg.

Additionally, traditional theory relies primarily upon the direct impact of the weight of the body to drive the cleats into the ground, regardless of the condition of the ground which can, under unfavorable conditions, cause the cleats to recoil off the ground. Finally, the prior art shoes provide a spike of a height similar or equal to the height of the weight bearing cleats at the forwardmost portion of the sole to increase traction. However, such a spike does not have a significant effect on traction and is a major cause of injuries.

What is desired, therefore, is a cleat arrangement that provides for maximum stability and traction, while reducing the likelihood of injury to the foot and leg. The cleat arrangement should also minimize the torque on the leg and not primarily rely upon the weight of the body to drive the cleats into the ground.

SUMMARY OF THE PRESENT INVENTION

A sole for a sport shoe to provide increased traction and stability comprises a main sole member having a heel portion including a heel curve, and a forward portion underlining the ball of the foot including a toe curve. The sole has a center point defined by the intersection of an optical center line and a transverse line. The optical center line is defined by a line that extends between a point midway in the toe curve and a point midway in the heel curve. The transverse line is a line extending perpendicular to a tangent line at a tangent point in the forward portion. The tangent line is a line that is drawn tangent to both the medial side of the forward portion and the medial side of the heel portion, and the tangent point is where the tangent line contacts the forward portion. The optical center line and the transverse line defines four quadrants, namely, a forward lateral, a forward medial, a rearward lateral, and a rearward medial. The transverse line has a length equal to the distance between its intersection with the medial and lateral sides of the sole. A forward medial cleat is located on a first radial line that radiates from the center point at a 25–35 degree angle to the medial side of the optical center line, and is spaced between 39% and 49% of the length of the transverse line from the center point. A rearward lateral cleat is located on a second radial line that radiates from the center point at a 125–135 degree angle to the lateral side of the optical center line, and is spaced between 54% and 64% of the length of the transverse line from the center point.

Preferably, the forward medial cleat is located at an angle of 30 degrees and a spacing of generally 44%, and the rearward lateral cleat is located at an angle of 130 degrees and a spacing of 59%.

A rearward medial cleat and a forward lateral cleat are respectively located in the rearward medial quadrant and the forward lateral quadrant.

In a preferred embodiment the forward lateral cleat is located on a third radial line that radiates from the center point at a 43–53 degree angle to the lateral side of the optical center line. Preferably, this cleat is spaced between 42% and 52% of the length of the transverse line from the center point. In addition, the rearward medial cleat is located on a fourth radial line that radiates from the center point at a 142–152 degree angle to the medial side of the optical center line. This cleat is spaced between 34% and 44% of the length of the transverse line from the center point. Preferably, the forward lateral cleat is at an angle of 48 degrees and a spacing of generally 47% and the rearward medial cleat is at an angle of 147 degrees and a spacing of generally 39%.

The cleat arrangement of the present invention provides improved traction and stability by moving the center of a substantially circular pattern from a point on or forward of the metatarsals, to an oblong or egg-shaped cleat arrangement focused around a center point located rearward of the metatarsals. The center point provides a central location around which the cleats are arranged that is consistent with the center of gravity of the wearer. With a focus on the center of gravity and not the pivot point, greater stability is achieved. The forward medial and rearward lateral cleats are located in line with the natural motion of the foot which permits a leveraging effect between the cleats to drive them into the ground to increase traction while reducing the possibility of recoil.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figures 1, 2, 3:
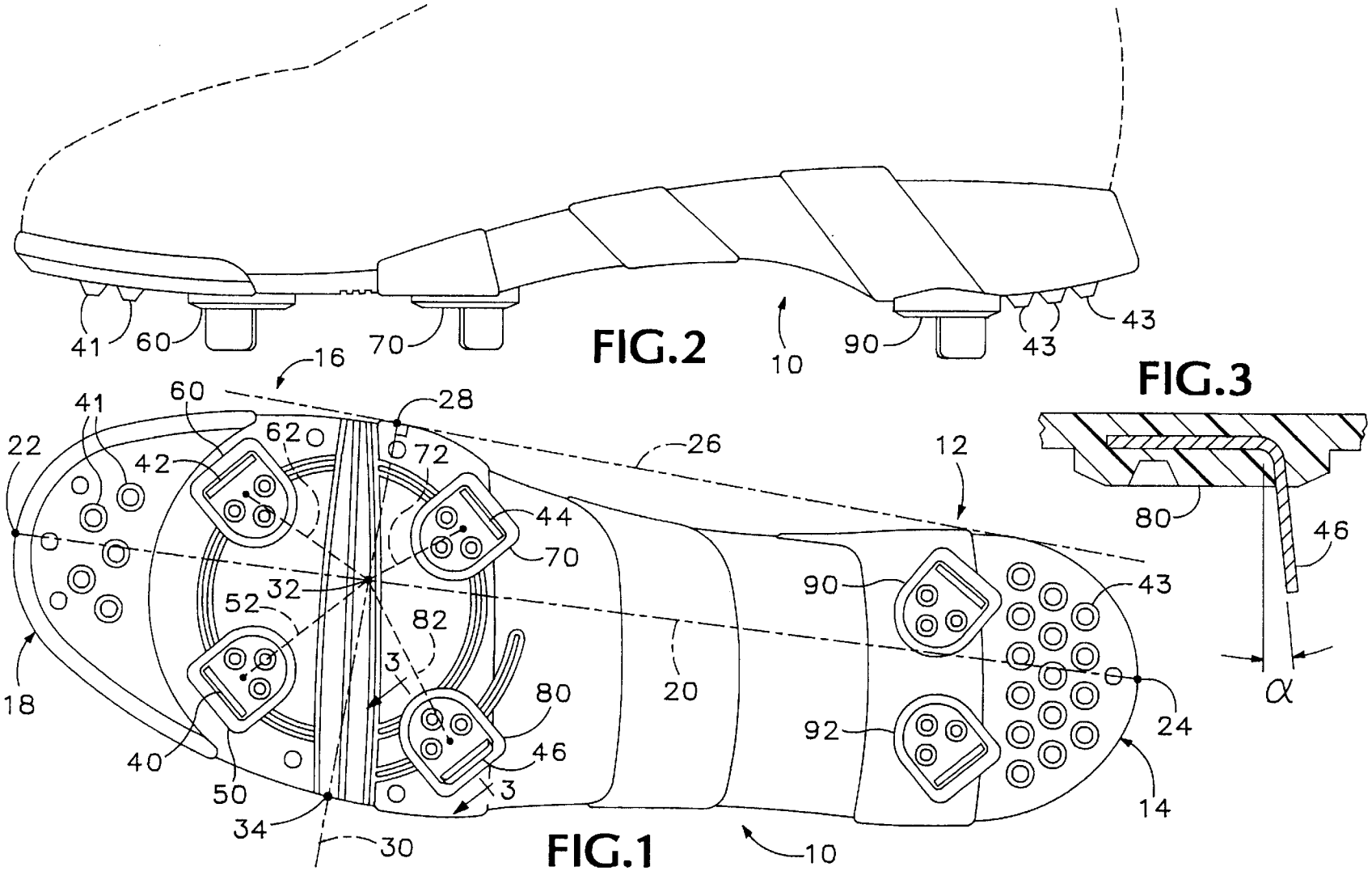
FIG. 1 is an exemplary embodiment of a cleated athletic shoe with a cleat arrangement in accordance with the present invention.
FIG. 2 is a partial side view of FIG. 1 showing the height of individual cleats and spikes.
FIG. 3 is a sectional view along line 3—3 of FIG. 1 showing the preferred angle of the rearward lateral cleat.

Referring to FIG. 1, an athletic shoe has a main sole 10 which includes a heel portion 12. The heel portion 12 further includes a heel curve 14 and a plurality of short buttons 43. The main sole 10 has a forward portion 16 underlying the ball of the foot which includes a toe curve 18. Four cleats 50, 60, 70 and 80 are located on the forward portion 16 and a pair of cleats 90 and 92 are located on the heal portion 12 to provide traction to the ground.

To provide for maximum traction and stability the forward cleat arrangement in the subject shoe is not centrally located around a position forward of the metatarsals as is the case with the prior art, but, in contrast, it is centered generally around the center of gravity point of the sole 10. To locate the center of gravity point on the shoe, first an optical center line 20 is drawn from a point 22 midway on the toe curve 18 to a point 24 midway on the heel curve 14. Next, a tangent line 26 is drawn tangent to the widest points of both of the medial out sole of the forward portion 16 and the heel portion 12. A transverse line 30 is drawn perpendicular to the tangent line 26 at point 28, which is the tangent point of tangent line 26 on the forward portion 16. The intersection of the optical center line 20 and the transverse line 30 is the center of gravity point 32 for the sole. The determination of the center of gravity point 32 in this manner locates the center of gravity of soles that have different lengths and widths. The center of gravity 32 provides a location from which the positions of the individual cleats are located around. Proper cleat placement about the center of gravity 32, which is located at a point rearward of the metatarsal joint, allows for increased traction and stability than was previously obtainable. Prior cleat arrangements were centered about a point on the metatarsal joint or slightly forward of the metatarsal joint which does not provide the traction or stability that can be obtained by moving the center point rearward slightly.

The optical center line 20 and transverse line 30 define four quadrants on the sole 10, namely a forward lateral, a forward medial, a rearward lateral, and a rearward medial. A cleat is located in each of the four quadrants. The forward lateral cleat 50 is located on a radial line 52 which radiates from the center of gravity point 32 and is between 43 and 53 degrees to the lateral side of the optical center line 20. The center of the forward lateral cleat is offset from the center of gravity point 32 by a distance that is equal to between 42% and 52% of the length of the transverse line 30 (distance from point 28 to point 34). The forward medial cleat 60 is located on a radial line 62 which radiates from the center of gravity point 32 and is between 25 and 35 degrees to the medial side of the optical center line 20. The center of the forward medial cleat is offset from the center of gravity point 32 by a distance that is equal to between 39% and 49% of the length of the transverse line 30. The rearward medial cleat 70 is located on a radial line 72 which radiates from the center of gravity point 32 and is between 142 and 152 degrees to the medial side of the optical center line 20. The center of the rearward medial cleat is offset from the center of gravity point 32 by a distance that is equal to between 34% and 44% of the length of the transverse line 30. The rearward lateral cleat 80 is located on a radial line 82 which radiates from the center of gravity point 32 and is between 125 and 135 degrees to the lateral side of the optical center line 20. The center of the rearward lateral cleat is offset from the center of gravity point 32 by a distance that is equal to between 54% and 64% of the length of the transverse line 30. Preferably, the forward lateral cleat is located at an angle of 48 degrees and a spacing of 47.4%; the forward medial cleat is located at an angle of 30 degrees and a spacing of 44.2%; the rearward medial cleat is located at an angle of 147 degrees and a spacing of 39.5%; and the rearward lateral cleat is located at an angle of 130 degrees and a spacing of 58.9%. Each cleat 50, 60, 70, and 80 has a respective metal blade 40, 42, 44, and 46 for traction. Blades 40, 42, 44, and 46 are respectively angled at 42 degrees to the medial side, 47 degrees to the lateral side, 43 degrees to the medial side and 46 degrees to the lateral side, of the optical center line 20. While the above values have been found to be optimum, small variations in the spacing and angles are within the scope of the present invention.

The area of the sole where cleats need to be placed to obtain maximum traction and stability when the maximum portion of the sole contacts the playing surface is oblong, or more arcuately egg-shaped, in character moving transversely across the sole from a point laterally behind the metatarsals to a point medially forward of the metatarsals. There is no single location that a circular pattern of cleats can be placed to offer maximum traction and stability without interference with the natural motion of the straining foot, and clearly any point forward of the metatarsals is inconsistent with the natural motion of the foot.

Accordingly, the rearward lateral cleat 80 is located behind the metatarsal joint chain of the foot at an angle perpendicular to the direction of the most extreme lateral force that the majority of actions a player would exert when changing direction while running. Such a position reduces the potential for the rearward lateral cleat 80 to exert an opposing force causing the body to move beyond the plane of balance before the foot, ankle and leg can absorb the shock of a change in direction. The forward medial cleat 60 also is moved outward on the sole 10 from its traditional placement and rotated to a position generally in line with the motion created as the foot moves from its supinated impact to its pronated push off in an athlete's stride.

Traditional cleat arrangements rely primarily upon the direct impact of the cleats into the surface to provide the necessary traction which can frequently result in the cleats recoiling off the surface. The current cleat arrangement relies to a greater degree on leveraging between cleats 80 and 60 to provide consistent traction. After the initial contact of the rearward lateral cleat 80 with the playing surface the downward force of body weight through the metatarsal joint chain may drive the rearward lateral cleat 80 into the playing surface. But even if it does not, the spacing of cleats 60 and 80 and their placement in line with the foot's motions permits all the cleat members to flex outwardly from the center of gravity 32, effectively leveraging against each other as the metatarsal joint continues its own uninhibited travel to the playing surface allowing all the cleats to provide traction, even if there is little or no penetration into the playing surface.

Currently all baseball shoes have at least one cleat height spike placed at the front of the sole 10 at a point beyond any mechanical advantage from the action of the foot. Some baseball shoes have more than one spike in close proximity to each other at this location. The forwardmost placement of a spike creates an extreme potential for tripping and is well documented in the history of baseball as one of the sport's leading causes of knee and ankle injury. It has been determined by the present inventor that elimination of or the reduction of the height of the front spike improves safety and that the main cleat arrangement of the subject invention provides the required traction and stability without the need for the forward spike. Elimination or reduction of the forwardmost spike permits a significant reduction in the potential for tripping and injury. The forwardmost spike is preferably replaced by a plurality of studs or spikes 41 of a height less than half the height of the other cleats placed elsewhere on the main sole 10. This allows natural motion of the foot without striking the forwardmost spikes or studs 41 prior to impacting the other traction cleats placed on the sole 10.

In the prior art cleated shoes, all cleats, regardless of the positioning, have a metal blade that extends at substantially a right angle from the main sole 10. Since the normal mechanical action of the foot is to impact the surface in a pronated fashion, i.e., the lateral side first, then flatten and push off in supinated position, i.e., medial side last, a cleat having a perpendicular metal plate induces strong torque forces. The farther forward the cleat 80 is located towards the lateral side of the metatarsal joint chain, the more pronounced the torque effect becomes and the greater the potential for tripping becomes if the momentum of the player's movement carries his or her center of gravity to a point directly over the cleat 80. Referring to FIG. 3, the rearward lateral cleat 80 of the subject invention is offset from the perpendicular by an angle $\alpha$. Preferably, $\alpha$ is 3–8 degrees from perpendicular to the lateral side of the main sole 10 to more effectively permit entering the ground by the pronated foot upon impact directly in line with and at a right angle to the force required for traction in either a change of direction or running in a straight line. This increases the efficiency of the cleat 80 by reducing the potential for equipment failure and reduces the torque potential for turning the foot under the ankle if the cleat 80 is obstructed from entering the playing surface.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A sole for a sport shoe to provide increased traction and stability comprising:

(a) a main sole member having medial and lateral sides, a heel portion at the rear thereof, and a forward portion at the front thereof underlying the ball of the foot;

(b) said sole member having a toe curve defined by the outer edge of said forward portion from a tangent point to an opposing point;

(c) wherein a tangent line is a line that is tangent to both the medial side of said forward portion and said heel portion, and said tangent point is where said tangent line contacts said forward portion;

(d) wherein a transverse line is defined by a line extending perpendicular to said tangent line at said tangent point in said forward portion, said opposing point is where said tangent line crosses the lateral side of said forward portion;

(e) said sole member having a heel curve defined by the outer edge of that portion of said heel portion that curves inwardly toward the center of said sole member as it extends rearwardly;

(f) said main sole member having a center point defined by the intersection of an optical center line and said transverse line, said optical center line defined by a line that extends between the midpoint of said toe curve and a heel point, where said heel point is defined as the point of said heel curve that is farthest distant from said midpoint of said toe curve;

(g) said optical center line and said transverse line dividing said forward portion into four quadrants, namely, forward lateral, forward medial, rearward lateral, and rearward medial;

(h) said transverse line having a length equal to the distance between its intersections with the medial and lateral sides of said sole;

(i) a forward medial cleat having a first point located at the center of said forward medial cleat, said first point of said forward medial cleat located on a first radial line that radiates from said center point at a 25–35 degree angle to the medial side of said optical center line and spaced between 39% and 49% of said length of said transverse line from said center point;

(j) a forward lateral cleat located in said forward lateral quadrant;

(k) a rearward lateral cleat having a second point at the center of said rearward lateral cleat, said second point of said rearward lateral cleat located on a second radial line that radiates from said center point at a 125–135 degree angle to the lateral side of said optical center line and spaced between 54% and 64% of said length of said transverse line from said center point; and (l) a rearward medial cleat located in said rearward medial quadrant.

2. The sole of claim 1, wherein:

(a) said forward lateral cleat is located on a third radial line that radiates from said center point at a 43–53 degree angle to the lateral side of said optical center line and spaced between 42% and 52% of said length of said transverse line from said center point; and (b) said rearward medial cleat is located on a fourth radial line that radiates from said center point at a 142–152 degree angle to the medial side of said optical center line and spaced between 34% and 44% of said length of said transverse line from said center point.

3. The sole of claim 1, wherein said first radial line radiates from said center point at a 30 degree angle to the medial side of said optical center line.

4. The sole of claim 1, wherein said second radial line radiates from said center point at a 130 degree angle to the lateral side said optical center line.

5. The sole of claim 2, wherein said third radial line radiates from said center point at a 48 degree angle to the lateral side of said optical center line.

6. The sole of claim 2, wherein said fourth radial line radiates from said center point at a 147 degree angle to the medial side of said optical center line.

7. The sole of claim 1, wherein said spacing of said forward medial cleat is generally 44% of said length of said transverse line from said center point.

8. The sole of claim 1, wherein said spacing of said rearward lateral cleat is generally 59% of said length of said transverse line from said center point.

9. The sole of claim 2, wherein said spacing of said forward lateral cleat is generally 47% of said length of said transverse line from said center point.

10. The sole of claim 2, wherein said spacing of said rearward medial cleat is generally 39% of said length of said transverse line from said center point.

11. The sole of claim 1, further comprising at least one spike located in close proximity to said toe curve of a height less than half the height than any of said cleats.

12. The sole of claim 1, wherein said rearward lateral cleat is orientated at an angle between 3 and 8 degrees to the lateral side of perpendicular with respect to said sole.

* * * * *